US005156408A

United States Patent [19]

Hall

[11] Patent Number: 5,156,408

[45] Date of Patent: Oct. 20, 1992

[54] NET SUPPORT

[76] Inventor: John F. Hall, 4916 Walker Blvd., Erie, Pa. 16509

[21] Appl. No.: 804,003

[22] Filed: Dec. 9, 1991

[51] Int. Cl.[5] ..... A63B 61/02

[52] U.S. Cl. ..... 273/411; 273/29 BB

[58] Field of Search ..... 273/411, 29 B, 29 BA, 273/29 BB

[56] References Cited

FOREIGN PATENT DOCUMENTS 497295 12/1938 United Kingdom ..... 273/29 BB

*Primary Examiner*—William H. Grieb

*Attorney, Agent, or Firm*—Lovercheck and Lovercheck

[57] ABSTRACT

An apparatus for supporting nets for tennis, badminton, volleyball or the like made up of a portable structure to enable quick and easy erection, compact storage, light weight for transportation and is strong and durable when erected. A cross member is pivoted to the lower end of a post and is adjustable to account for an inclined surface. A leg is swingably attached to the post and of adjustable length so that the post can be adjusted perpendicular to a horizontal surface.

10 Claims, 2 Drawing Sheets

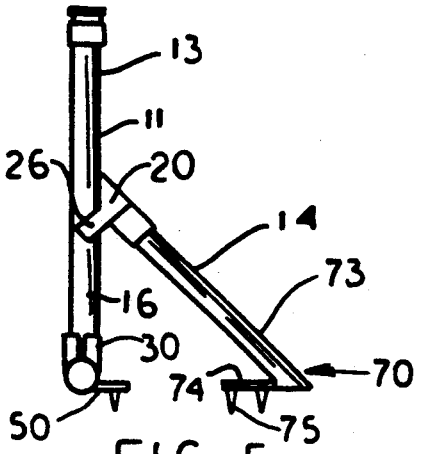
FIG. 5
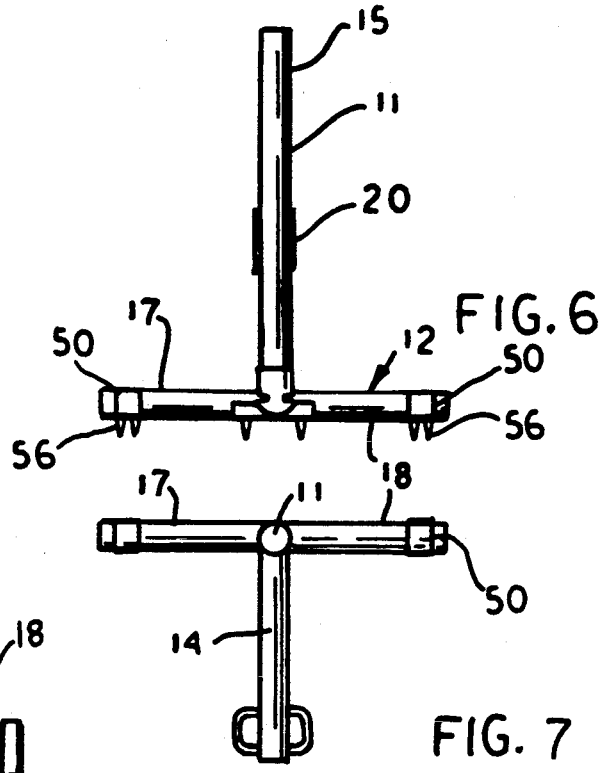
FIG. 6
FIG. 7
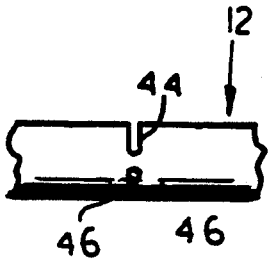
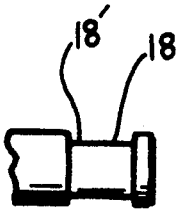
FIG 8
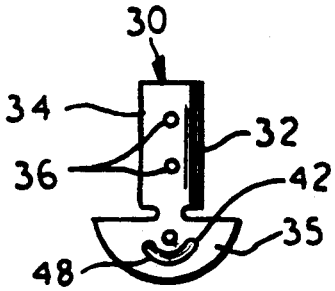
FIG. 9
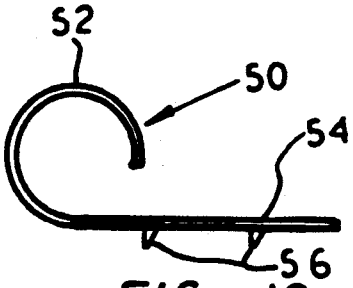
FIG. 10
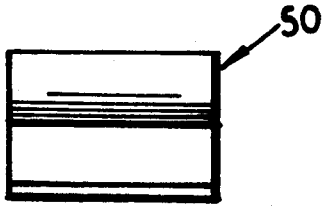
FIG. 11

NET SUPPORT

BACKGROUND OF THE INVENTION

This invention generally relates to the field of sporting goods and equipment, and more particularly to a portable means for supporting a net required for net games, such as tennis, badminton, volleyball, or the like.

The interest in the game of net games has increased during the last several years and there are many new tennis courts. However, there is a need for simple, economical and efficient net supports that can be set up quickly and efficiently and can easily be transported and stored.

Applicant is aware of the following prior art:

U.S. Pat. No. 494,913 to Booth for a lawn tennis fork.

U.S. Pat. No. 1,327,072 to Thorward for a game apparatus.

U.S. Pat. No. 2,937,872 to Gilman for a self-erecting football dummy.

U.S. Pat. No. 3,940,139 to Barnes for an out-of-bounds wand for volleyball net and support strap.

U.S. Pat. No. 3,986,719 to Lee for a portable ball target.

U.S. Pat. No. 3,968,968 to Peterson for a mini-volleyball court layout utilizing net support pots with heavy round bases.

U.S. Pat. No. 3,980,299 to Brown for a tennis game apparatus kit.

U.S. Pat. No. 4,135,716 to Ginsburg for a portable means for supporting a net utilizing a tripod at each post and a weight for holding the posts in place. These tripods are difficult to transport and the weight is backward and heavy to transport.

U.S. Pat. No. 4,372,561 to Morgan et al for a volleyball practice apparatus.

U.S. Pat. No. 4,415,163 to Schoenig for a portable volleyball apparatus.

U.S. Pat. No. 4,720,112 to Stettner et al for an adjustable standard for net games.

U.S. Pat. No. 4,830,382 to Wheeler for a portable volleyball net support system.

U.S. Pat. No. 4,844,477 to Pardi for a game net assembly.

U.S. Pat. No. 4,948,150 to Daly, Jr. et al for a volleyball practice system.

The present invention overcomes the limitations of the short comings of the prior art and discloses a structure that can be used on most suitable surfaces and can be folded to a compact package of minimum dimensions for transportation and storage.

SUMMARY OF THE INVENTION

The present invention is a portable structure which enables easy and rapid erection of a tennis, badminton or volleyball court on any relatively suitable surface. The present invention contemplates the use of tubular support members which can be made of plastic or light weight metal and can be easily attached together; all provided with simple, efficient fittings for providing the pivot joints for connecting the tubular members and angular leg supports to the support posts.

It is the object of the invention to provide an improved support for a net game such as tennis, badminton, volleyball nets, and the like.

Another object of the invention is to provide a net support that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWINGS

FIG. 5 is another partial side view of the net support.

FIG. 6 is a partial end view of the net support.

FIG. 7 is a top view of the net support.

FIG. 8 is a partial side view of a cross member.

FIG. 9 is a side view of a bracket, according to the invention.

FIG. 10 is a side view of an end clip.

FIG. 11 is a top view of the end clip shown in FIG. 10.

DESCRIPTION OF THE PREFERRED EMBODIMENTS

Figure 1:
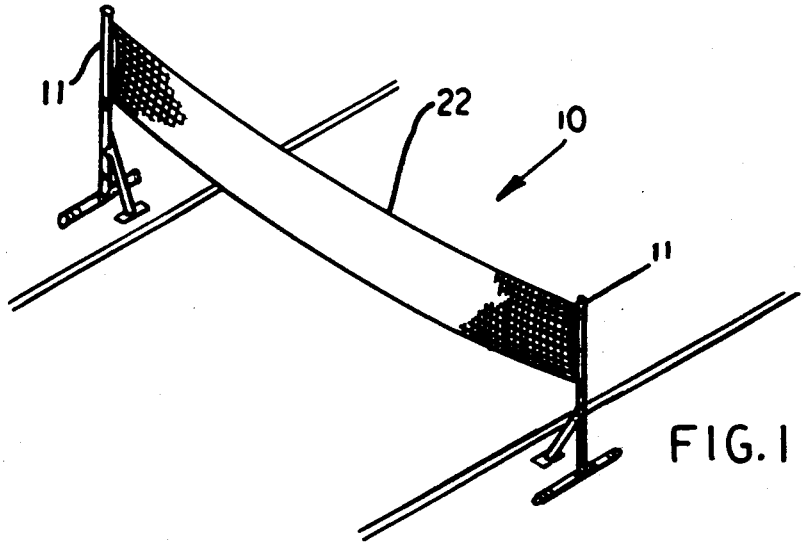
FIG. 1 is an isometric view of a net support set up for use, according to the invention.

Now with more particular reference to the drawings, portable net support 10 for a net game is shown supported on two posts 11, each post having upper part 15, lower part 16 and intermediate part 13. Upper part 15 of post 11 is telescopically received in lower part 16 and may be locked in place by a locking means having a rotatable collar of a type familiar to those skilled in the art. Net 22' is attached to posts 11 by cords or other well known fastening means.

Figure 2:
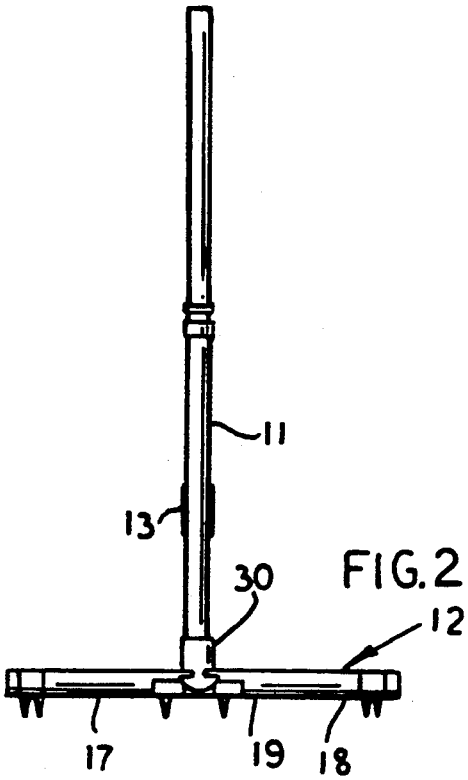
FIG. 2 is an enlarged partial end view of the net support shown in FIG. 1.
Figure 3:
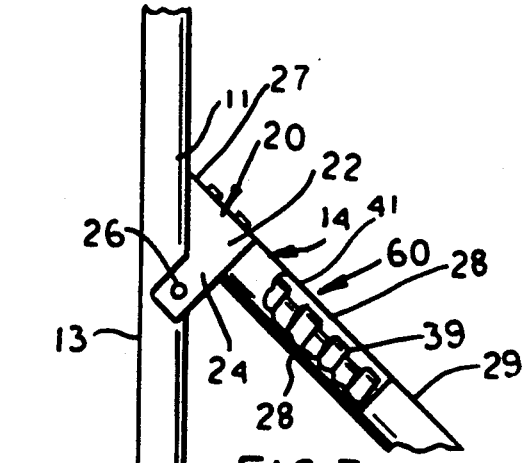
FIG. 3 is an enlarged partial side view of a part of the net support.

When portable net support 10 is to be erected, cross member 12 is swung to the position shown in FIG. 2, perpendicular to posts 11. Leg 14 is swung to the position shown in FIGS. 3 and 5. Cross member 12 and plate like member 74 of leg clip 70 rests on the ground and stabilize posts 11. For transportation and storage, cross member 12 and leg 14 may be swung to a position parallel to post 11 to form a compact package.

Cross member 12 has first reduced size end 17, intermediate part 19, and second reduced size end 18 which define circumferential groove 18'. Intermediate part 19 of cross member 12 is swingably attached to lower end 16 of post 11 by bracket 30. Bracket 30 is made up of two bracket parts 32. Bracket parts 32 each have half cylindrical part 34 and flat part 35. Half cylindrical part 34 receives lower end 16 of post 11 and is clamped to post 11 by through bolts 36. Flat part 35 is integrally attached to half cylindrical part 34 and bolt 43 extends through holes 46 in cross member 12 and arcuate slot 48 in flat part 35. Pivot pin 42 extends through flat part 35 and through vertical slot 44 in cross member 12. Bolt 43 may have wing nut 60 thereon to clamp cross member 12 in an adjusted position.

Leg 14 is swingably attached to intermediate part 13 of post 11 by clip 20 and by pivot bolt 26. Clip 20 has a U-shaped body in the form of a half cylinder part 22 with two integrally attached spaced legs 24. Half cylinder part 22 has axially extending extension 27 protruding from its end which engages post 11 and acts as a stop to limit the upward swinging movement of leg 14 relative to post 11 and to hold post 11 in an erect position when set up on a flat surface. Pivot bolts 26 extend through spaced legs 24 and through post 11 to swingably connect spaced legs 24 to posts 11 at a position spaced from cross member 12.

End clips 50 have plate-like members 54 integrally attached to part cylindrical members 52 with spikes 56 integrally attached to plate-like members 54 and extending downwardly therefrom which can penetrate turf and hold cross member 12 in position on soft surfaces, such as lawns and play grounds.

Leg clip 70 has hollow cylindrical part 73 which receives an end of leg 14. Plate-like member 74 of end clip 70 is integrally attached to hollow cylindrical part 73 and spikes 75 are integrally attached to plate-like member 74.

Leg 14 is made up of first leg part 28 and second leg part 29. First leg part 28 has nut 41 fixed thereto which receives threaded screw 39. By rotating second leg part 29, the overall length of leg 14 can be regulated to adjust post 11 to a perpendicular position relative to the supporting surface.

Figure 4:
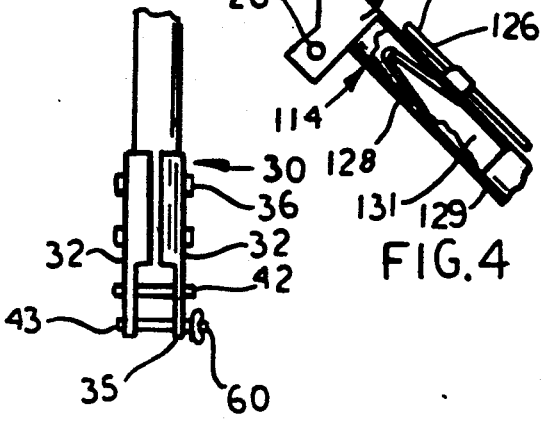
FIG. 4 is another partial side view of a leg of the net support partly broken away.

As shown in the embodiment of FIG. 4, the adjusting mechanism is of a type familiar to those skilled in the art. Clip 20 is supported on first leg part 128 of leg 114. First leg part 128 receives reduced size end 131 of second leg part 129. Detent lever 125 has a detent which may be received in spaced holes 126 in second leg part 129 and when the detent is moved out of holes 126, second leg part 129 may be slid relative to first leg part 128 to a different hole thereby adjusting the overall length of leg 114.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A portable net support comprising two posts adapted to be supported in spaced relation to one another on a supporting surface, each of said posts having an upper end, an intermediate part and a lower end, each of said posts having a cross member and a leg, a clip means swingably supporting said leg to said intermediate part of each said post, bracket means swingably supporting said cross member on said lower end of said post, a limit means on said bracket means extending outward from a first end of said leg to limit the swinging movement of said leg relative to said posts, said cross member and said legs being adapted to rest on a supporting surface and said posts being adapted to support a net.

2. The net support recited in claim 1 wherein said leg comprises a first leg member, a second leg member and an adjusting means on said first leg member for adjusting said second leg member relative to said first leg member thereby adjusting the overall length of said leg whereby said post can be supported on a support surface generally vertical thereto with said leg swung to a position at an acute angle to said post or said leg can be swung to a position generally parallel to said post for transportation and for storage.

3. The net support recited in claim 2 wherein said first leg part and said second leg part are telescopically connected together;

said adjustable means comprises a spring loaded detent lever on said first leg part; and, a plurality of spaced openings receive said detent lever in said second leg part for holding said first leg part and said second leg part in adjusted positions.

4. The net support recited in claim 2 wherein said adjusting means comprises a screw and a nut.

5. The net support recited in claim 1 wherein said bracket means comprises two spaced bracket parts;

said lower end of said post is received between said spaced bracket parts; and, a clamping means clamping said spaced bracket parts to said lower end of said post.

6. The net support recited in claim 5 wherein said cross member has an intermediate part having a vertical slot therein;

a hole in said cross member spaced from said vertical slot;

each said spaced bracket part having a half cylindrical part and a lower flat part;

a pivot pin extending through said vertical slot and through said lower flat part swingably connecting said cross member to said post;

an arcuate slot in each said spaced bracket part having a center of curvature at said pivot pin;

a bolt in said arcuate slot extending through said hole in said cross member and a fastening means on said bolt.

7. The net support recited in claim 6 wherein said fastening means comprises a wing nut whereby said cross member may be locked in a selected angular relation to said posts.

8. The net support recited in claim 6 wherein end clips are provided;

one said end clip is fixed to a first reduced size end of said cross member and one said clip is fixed to a second reduced size end of each said cross member;

said first reduced size end and said second reduced size end defining a circumferential groove; and, said end clips having a generally cylindrical part received in said groove and curving to a straight plate-like part adapted to rest on the ground.

9. The net support recited in claim 8 wherein each said plate-like part of each said end clip has a spike attached thereto and extending downwardly therefrom.

10. The net support recited in claim 1 wherein said leg has a first leg part and a second leg part and an adjusting means on said leg to adjust the length of said leg.

* * * * *